US007725070B2

(12) United States Patent
Fukunaga et al.

(10) Patent No.: US 7,725,070 B2
(45) Date of Patent: May 25, 2010

(54) WASTE TONER COLLECTING DEVICE AND IMAGE FORMING APPARATUS LOADED THEREWITH

(75) Inventors: Yasuyuki Fukunaga, Osaka (JP); Koji Murata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 143 days.

(21) Appl. No.: 12/216,618

(22) Filed: Jul. 8, 2008

(65) Prior Publication Data

US 2009/0022532 A1 Jan. 22, 2009

(30) Foreign Application Priority Data

Jul. 10, 2007 (JP) ..... 2007-180609

(51) Int. Cl.
*G03G 21/12* (2006.01)

(52) U.S. Cl. ..... 399/360; 399/99; 399/120

(58) Field of Classification Search ..... 399/35, 399/99, 120, 358, 360
See application file for complete search history.

(56) References Cited

U.S. PATENT DOCUMENTS 5,781,841 A * 7/1998 Kouroku et al. ..... 399/360
7,107,002 B2 * 9/2006 Saito et al. ..... 399/360

FOREIGN PATENT DOCUMENTS

JP 3-182789 8/1991
JP 3451076 7/2003

* cited by examiner

*Primary Examiner*—David P Porta
*Assistant Examiner*—Mark R Gaworecki
(74) *Attorney, Agent, or Firm*—Smith, Gambrell & Russell, LLP

(57) ABSTRACT

A waste toner collecting device includes: a waste toner collecting bag being stretchable; a toner conveyance part fitted with the waste toner collecting bag, and conveying a waste toner and also discharging the waste toner toward the waste toner collecting bag; and a holding member for the waste toner collecting bag, which holding member is attached to a terminal end part of the waste toner collecting bag, is capable of being fitted to the toner conveyance part by holding the waste toner collecting bag between the holding member and the toner conveyance part while folding the waste toner collecting bag more compactly than in a used state, and is attachable to and removable from the toner conveyance part.

9 Claims, 10 Drawing Sheets

WASTE TONER COLLECTING DEVICE AND IMAGE FORMING APPARATUS LOADED THEREWITH

This application is based on Japanese Patent Application No. 2007-180609 filed on Jul. 10, 2007, the contents of which are hereby incorporated by reference.

BACKGROUND OF THE INVENTION

1. Field of the Invention

The present invention relates to a waste toner collecting device for collecting a toner remaining on the surface of an image carrier or an intermediate transfer body. The invention also relates to an image forming apparatus loaded with this waste toner collecting device.

2. Description of Related Arts

In an image forming apparatus of an electrophotographic type, widely used is a transfer method of forming a transfer region with a photoconductive drum as an image carrier and a transfer roller as a transfer member in contact or in proximity with each other, inserting paper through this section, and transferring onto the paper a toner image formed on the surface of the photoconductive drum. With such a transfer method, after the toner image transfer onto the paper, a slight amount of toner may remain on the surface of the photoconductive drum without being transferred to the paper. This toner remaining on the surface of the photoconductive drum impedes the next new image formation, and thus requires cleaning by a cleaner.

Moreover, in an image forming apparatus primarily transferring a toner image formed on the surface of a photoconductive drum onto an intermediate transfer body and then secondarily transferring the toner image transferred on the surface of the intermediate transfer body onto paper, a slight amount of toner may also remain on the surface of the intermediate transfer body without being transferring to the paper. This toner remaining on the surface of the intermediate transfer body also requires cleaning by a cleaner.

A waste toner collected by the cleaner is conveyed into a pipe by a conveyance member such as a screw and collected by a waste toner collecting device. The waste toner collecting device includes a waste toner collecting container which introduces and stores a waste toner. One example of such a waste toner collecting container can be observed in Japanese Patent No. 3451076.

This conventional waste toner collecting container is typically formed of synthetic resin such as ABS resin. Therefore, increasing the capacity of the waste toner collecting container for the purpose of storing a larger amount of waste toner brings about problems such as poor portability and needs for ensuring a wide space for storage.

Thus, one example of waste toner collecting devices suggested to solve the problems described above can be observed in JP-A-H3-182789 as a waste toner storage device for an image forming apparatus. This waste toner storage device for an image forming apparatus includes a stretchable bag as a waste toner collecting container.

Since this conventional waste toner storage device includes the stretchable bag, it is convenient to carry and can be folded or rounded to take up a smallest possible storage space. However, with this configuration, every time the bag is filled with a waste toner, the bag itself needs to be removed from a frame of the waste toner storage device, which is very inconvenient. Moreover, in order to prevent accidental breakage of the bag while it is stored, a container or the like for protecting the bag needs to be prepared separately.

To efficiently store a waste toner into the bag, the bag stored in a folded or rounded manner needs to be spread in a preferable form at an initial stage. In this regard, with the configuration described in Patent Document 2, there is no specifically defined way of spreading the bag, thus resulting in risk of insufficient spreading, which may bend or twist the bag. Therefore, the bag may no longer be able to store a larger amount of waste toner. As a result, the bag replacement rate declines, which may lead to a risk of very high running costs and also possibility of a problem that the waste toner overflows from an inlet port of the bag.

SUMMARY OF THE INVENTION

In view of the points described above, the present invention has been made, and it is an object of the invention to provide a waste toner collecting device which includes a stretchable waste toner collecting bag, which is capable of easily protecting the waste toner collecting bag in a stored state against accidental breakage, and also which is capable of being spread in a used state without being bent or twisted and also reliably storing a larger amount of waste toner. It is another object of the invention to provide a high-performance image forming apparatus loaded with such a waste toner collecting device.

To achieve the object described above, according to one aspect of the invention, a waste toner collecting device includes: a waste toner collecting bag being stretchable; a toner conveyance part fitted with the waste toner collecting bag, and conveying a waste toner and also discharging the waste toner toward the waste toner collecting bag; and a holding member for the waste toner collecting bag, which holding member is attached to a terminal end part of the waste toner collecting bag, which is capable of being fitted to the toner conveyance part by holding the waste toner collecting bag between the holding member and the toner conveyance part while folding the waste toner collecting bag more compactly than in a used state, and which is attachable to and removable from the toner conveyance part.

With this configuration, it is possible to protect the waste toner collecting bag while achieving its compactification when the waste toner collecting device is in a stored state. Then removing the holding member from the toner conveyance part and moving it away from the toner conveyance part while extending the folded waste toner collecting bag permits easily spreading the waste toner collecting bag into a preferable form. In this manner, a waste toner collecting device can be provided which is capable of easily protecting the waste toner collecting bag against accidental breakage, which is capable of spreading the waste toner collecting bag without bending or twisting it when using it, and also which is capable of reliably storing a larger amount of waste toner.

In the waste toner collecting device with the configuration described above, the holding member may be attachable to and removable from the toner conveyance part by using a snap-fit method.

With this configuration, it is possible to hold the waste toner collecting bag while keeping it folded without using a locking member such as a screw and also easily spread it. This permits achieving lower cost and power saving for operations involved in protecting and spreading the waste toner collecting bag.

In the waste toner collecting device with the configuration described above, the waste toner collecting bag may be held between the toner conveyance part and the holding member in such a manner as to be folded in a wave form from the toner conveyance part to the holding member.

With this configuration, no special processing is required for the form, folded state, and spread state of the waste toner collecting bag. Then it is possible to spread the waste toner collecting bag in a flexible form. Therefore, an even larger waste toner collecting bag can be folded compactly and can be spread while extended in various forms. As a result, it is possible to improve the effect that, while protecting the waste toner collecting bag in a stored state against accidental breakage, the waste toner collecting bag is extended in a form that facilitates the waste toner storage and then an even larger amount of toner is stored.

In the waste toner collecting device with the configuration described above, the waste toner collecting bag may be held between the toner conveyance part and the holding member in such a manner as to be folded in a bellows form from the toner conveyance part to the holding member.

With this configuration, it is possible to reliably and easily spread the waste toner collecting bag without bending or twisting the waste toner collecting bag to such an extent that makes it difficult to store a waste toner. As a result, it is possible to improve the effect that, while protecting the waste toner collecting bag in a stored state against accidental breakage, a larger amount of waste toner is stored in the waste toner collecting bag.

In the waste toner collecting device with the configuration described above, the toner conveyance part may include: a tubular member provided with a toner introduction port and a toner discharge port; a roller provided inside the tubular member and upstream of the toner discharge port in a toner conveyance direction, having a substantially horizontal axis of rotation, and being oval-shaped in vertical cross section; and a scraper provided on an inner wall of the tubular member downstream of the toner discharge port side of the roller in a rotation direction thereof and having a leading end thereof abutting the roller.

With this configuration, it is possible to deliver the waste toner collected from the toner introduction port further inside by the roller oval-shaped in vertical cross section and prevent its reversed flow by the action of the scraper. As a result, the waste toner can be pushed further inside of the bag even if the waste toner collecting bag has not been expanded much after the initial state and also even when the bag is deformed along with the waste toner collection. This therefore can prevent a problem that the waste toner accumulates at the toner conveyance part. Then since the waste toner is delivered further inside of the collecting bag by using the roller, the waste toner collecting bag is not necessarily so structured as to extend vertically. As a result, a waste toner collecting device can be provided which is capable of protecting the waste toner collecting bag in a stored state against accidental breakage and also which prevents a waste toner from accumulating at the toner conveyance part to thereby reliably store a larger amount of waste toner without providing design restrictions on the configuration of the device.

In the waste toner collecting device with the configuration described above, the waste toner collecting bag may be arranged in such a manner as to extend horizontally.

With this configuration, it is very effective in configuration that can ensure sufficient space for arranging the waste toner collecting bag in a horizontal direction although it cannot ensure a space in a vertical direction. In this manner, a waste toner collecting device can be provided which can easily protect the waste toner collecting bag in a stored state against accidental breakage, which can be spread in a preferable form when used, which can reliably store a larger amount of waste toner, and which extends horizontally long. This therefore can greatly widen the applicability of the waste toner collecting device capable of reliably storing a larger amount of waste toner.

In the waste toner collecting device with the configuration described above, the holding member may include a cover part covering surrounding of the waste toner collecting bag when fitted to the toner conveyance part.

With this configuration, the waste toner collecting bag can be completely stored and covered inside the holding member. Consequently, the waste toner collecting bag in a stored state can be reliably protected against accidental breakage and can also be spread without being bent or twisted when used.

According to another aspect of the invention, an image forming apparatus is loaded with a waste toner collecting device. The waste toner collecting device includes: a waste toner collecting bag being stretchable; a toner conveyance part fitted with the waste toner collecting bag, and conveying a waste toner and also discharging the waste toner toward the waste toner collecting bag; and a holding member for the waste toner collecting bag, which holding member is attached to a terminal end part of the waste toner collecting bag, which is capable of being fitted to the toner conveyance part by holding the waste toner collecting bag between the holding member and the toner conveyance part while folding the waste toner collecting bag more compactly than in a used state, and which is attachable to and removable from the toner conveyance part.

With this configuration, a high-performance image forming apparatus can be provided which can easily protect the waste toner collecting bag in a stored state against accidental breakage, which can spread the waste toner collecting bag without bending or twisting it when using it, and which can reliably store a larger amount of waste toner.

The image forming apparatus with the configuration described above may use toners of a plurality of colors and includes the single waste toner collecting device collecting the toners of all the colors.

With this configuration, even an image forming apparatus capable of color image formation using a plurality of colors does not require provision of waste toner collecting devices corresponding to the respective colors, which permits a reduction in the number of waste toner collecting bags to be stored. Therefore a risk that the waste toner collecting bag in a stored state suffers from accidental breakage can be reduced. Moreover, a reduction in the number of components and space saving can be achieved. This permits improving the effect that upon the use of the waste toner collecting bag, it can be spread without being bent or twisted and that a larger amount of waste toner can be reliably stored, and also the effect that the waste toner collecting bag in a stored state is protected, thus making it possible to achieve lower costs and downsizing of the image forming apparatus.

DETAILED DESCRIPTION OF PREFERRED EMBODIMENTS

Hereinafter, the embodiments of the present invention will be described, referring to FIGS. 1 to 11.

Figure 1:
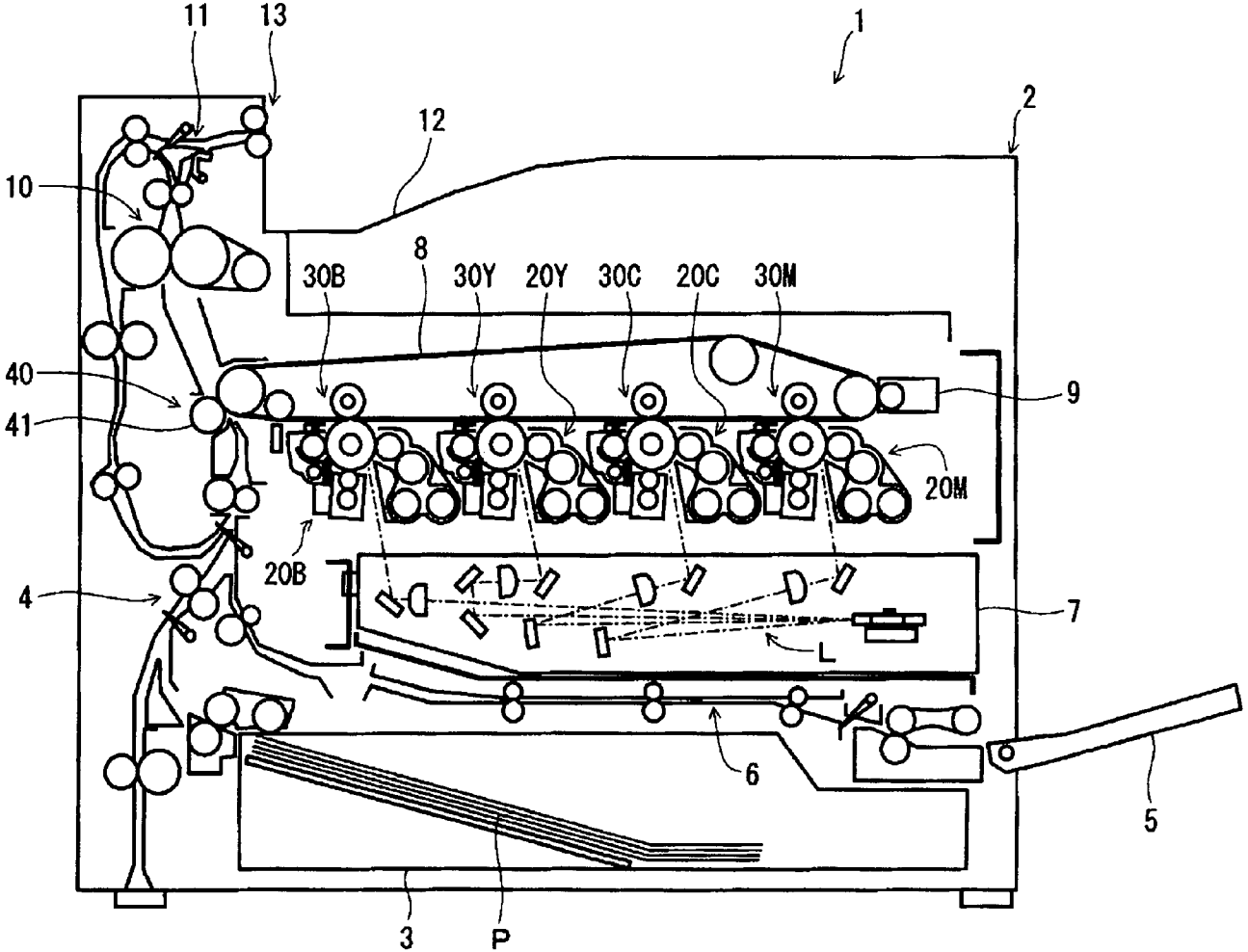
FIG. 1 is a schematic vertical sectional elevation of an image forming apparatus loaded with a waste toner collecting device according to a first embodiment of the present invention.
Figure 2:
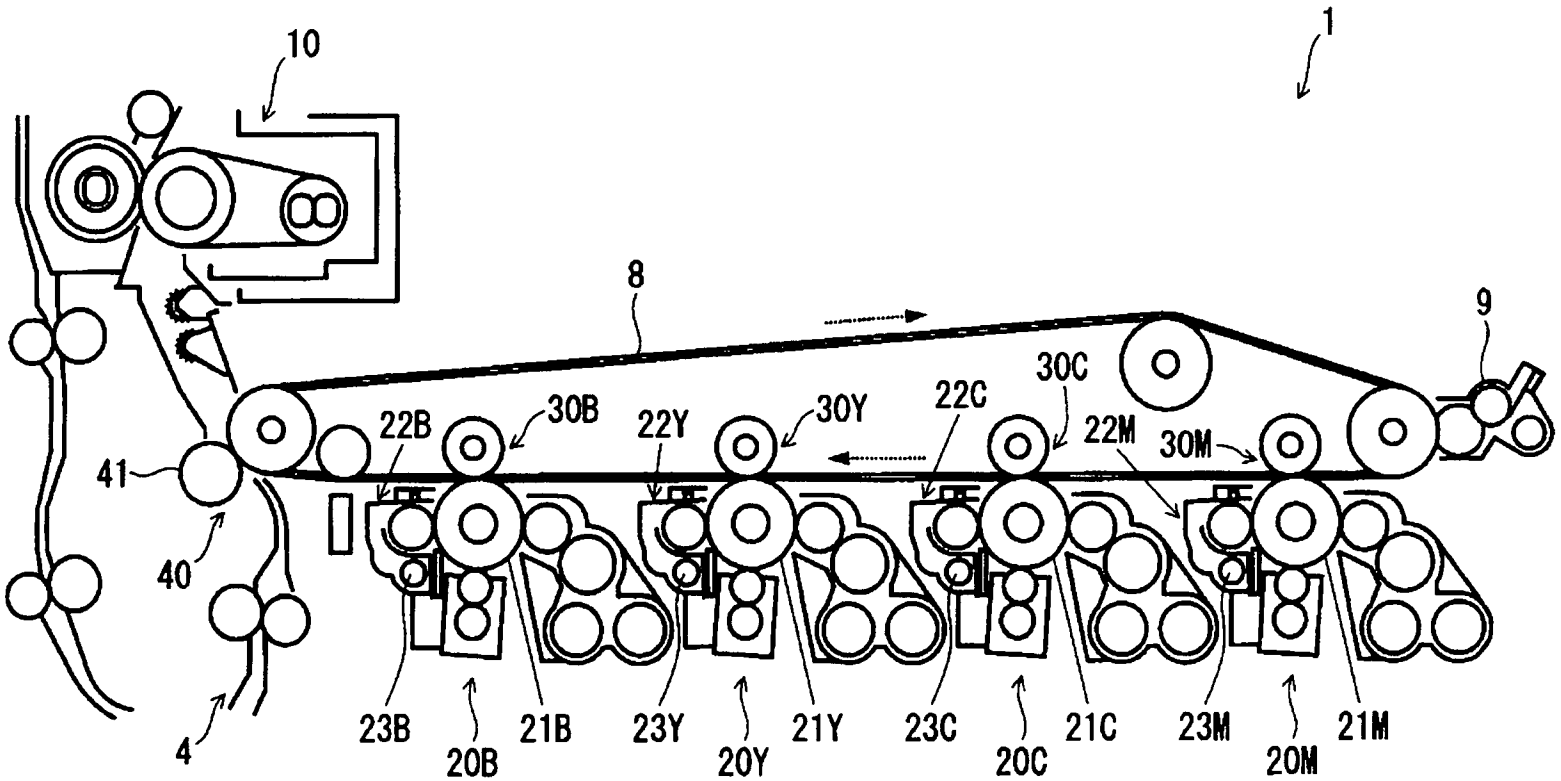
FIG. 2 is a partially enlarged vertical sectional view of the surrounding of image formation parts of the image forming apparatus shown in FIG. 1.

First, general structure and also image output operation of an image forming apparatus loaded with a waste toner collecting device according to the first embodiment of the invention will be descried, referring to FIGS. 1 and 2. FIG. 1 is a schematic vertical sectional elevation of the image forming apparatus, and FIG. 2 is a partially enlarged vertical sectional view of the surrounding of image formation parts shown in FIG. 1. This image forming apparatus is of a color-print type that transfers a toner image onto paper by using an intermediate transfer belt.

As shown in FIG. 1, at the inner bottom of a main body 2 of the image forming apparatus 1, a paper feed cassette 3 is arranged. The paper feed cassette 3 stores therein unprinted paper P such as cut paper in a stacked manner. Then this paper P is delivered leftward and upward of the paper feed cassette 3 in FIG. 1 while being separated one by one. The paper feed cassette 3 can be drawn horizontally from the front side of the main body 2.

Inside the main body 2 and to the left of the paper feed cassette 3, a first paper conveyance part 4 is provided. The first paper conveyance part 4 is built substantially vertically along the left side surface of the main body 2. Then the first paper conveyance part 4 receives the paper P delivered from the paper feed cassette 3, and conveys it vertically upward to a secondary transfer part 40 along the left side surface of the main body 2

Above the paper feed cassette 3 and on the right side surface of the main body 2 opposite to the left side surface thereof where the first paper conveyance part 4 is built, a manual paper feed part 5 is provided. On the manual paper feed part 5, those which are desired to be delivered one by one, such as paper P of sizes not included in the paper feed cassette 3, heavy paper, OHP sheets, or the like are placed.

To the left of the manual paper feed part 5, a second paper conveyance part 6 is provided. The second paper conveyance part 6 is located immediately above the paper feed cassette 3, extends substantially horizontally from the manual paper feed part 5 to the first paper conveyance part 4, and merges with the first paper conveyance part 4. Then the second paper conveyance part 6 receives the paper P or the like delivered from the manual paper feed part 5, and conveys it substantially horizontally to the first paper conveyance part 4.

On the other hand, the image forming apparatus 1 receives original image data from an external computer (not shown). Information of this image data is transmitted to a laser irradiation part 7 as exposure means arranged above the second paper conveyance part 6. By the laser irradiation part 7, laser light L controlled based on the image data is irradiated to image formation parts 20.

As shown in FIGS. 1 and 2, provided above the laser irradiation part 7 are a total of four image formation parts 20, further above which an intermediate transfer belt 8 using an intermediate transfer body in the form of an endless belt is provided. The intermediate transfer belt 8 is so supported as to be wound around a plurality of rollers, and is rotated by a driving device, not shown, clockwise in FIG. 2.

The four image formation parts 20 are, as shown in FIGS. 1 and 2, of a so-called tandem type that arranges them along a rotation direction of the intermediate transfer belt 8 in a row from the upstream side to downstream side in the rotation direction. The four image formation parts 20 include, in order from the upstream side: a magenta image formation part 20M; a cyan image formation part 20C; a yellow image formation part 20Y; and a black image formation part 20B. To these image formation parts 20, a developer (toner) is supplied by developer supply containers and conveyance means (not shown) respectively corresponding to these colors. In the description below, unless otherwise specified, identification symbols "M", "C", "Y", and "B" will be omitted.

In the respective image formation parts 20, electrostatic latent images of an original image are formed on the surfaces of respective photoconductive drums 21 by the laser light L irradiated by the laser irradiation part 7 serving as the exposure means, and toner images are developed from these electrostatic latent images. The toner images are primarily transferred onto the surface of the intermediate transfer belt 8 in primary transfer parts 30 respectively provided above the image formation parts 20. Then, along with rotation of the intermediate transfer belt 8, the respective toner images of the image formation parts 20 are transferred onto the intermediate transfer belt 8 at predetermined timing, thereby forming on the surface of the intermediate transfer belt 8 a color toner image in which the toner images of the four colors including magenta, cyan, yellow, and black are superimposed on one another.

After the primary transfer, adhesive substances such as toners remaining on the surfaces of the respective photoconductive drums 21 of the respective image formation parts 20 are cleaned and then stored by cleaners 22 for the photoconductive drums 21 which cleaners 22 are provided in the respective image formation parts 20. The waste toner temporarily stored in the cleaner 22 is discharged by a toner discharge screw 23 to a waste toner collecting device to be described later located outside the cleaner 22.

At a section where the intermediate transfer belt 8 reaches a paper conveyance path, a secondary transfer part 40 including a secondary transfer roller 41 is arranged. The color toner image temporarily carried on the surface of the intermediate transfer belt 8 is transferred, at a secondary transfer nip part formed by pressure contact between the intermediate transfer belt 8 and the secondary transfer roller 41, onto the paper P delivered in synchronization by the first paper conveyance part 4.

After the secondary transfer, an adhesive substance such as a toner remaining on the surface of the intermediate transfer belt 8 is cleaned and then stored by a cleaner 9 for the intermediate transfer belt 8, which cleaner 9 is provided upstream of the intermediate transfer belt 8 in the rotation direction of the magenta image formation part 20M.

Above the secondary transfer part 40, a fixing part 10 is provided. The paper P carrying the non-fixed toner image at the secondary transfer part 40 is delivered to the fixing part 10, where the toner image is heated and pressurized by a heat roller and a pressure roller and thereby fixed.

Above the fixing part 10, a branch part 11 is provided. The paper P discharged from the fixing part 10 is, when double-sided printing is not to be performed, discharged from the branch part 11 to a paper discharge part 12 provided at the top of the image forming apparatus 1.

A discharge port portion for the paper P discharged from the branch part 11 toward the paper discharge part 12 functions as a switch back part 13. To perform the double-sided printing, the conveyance direction of the paper P discharged from the fixing part 10 is switched in this switch back part 13. Then the paper P is delivered downward through the branch part 11, the left of the fixing part 10, and the left of the secondary transfer part 40, and then delivered again to the secondary transfer part 40 via the first paper conveyance part 4.

Figure 3:
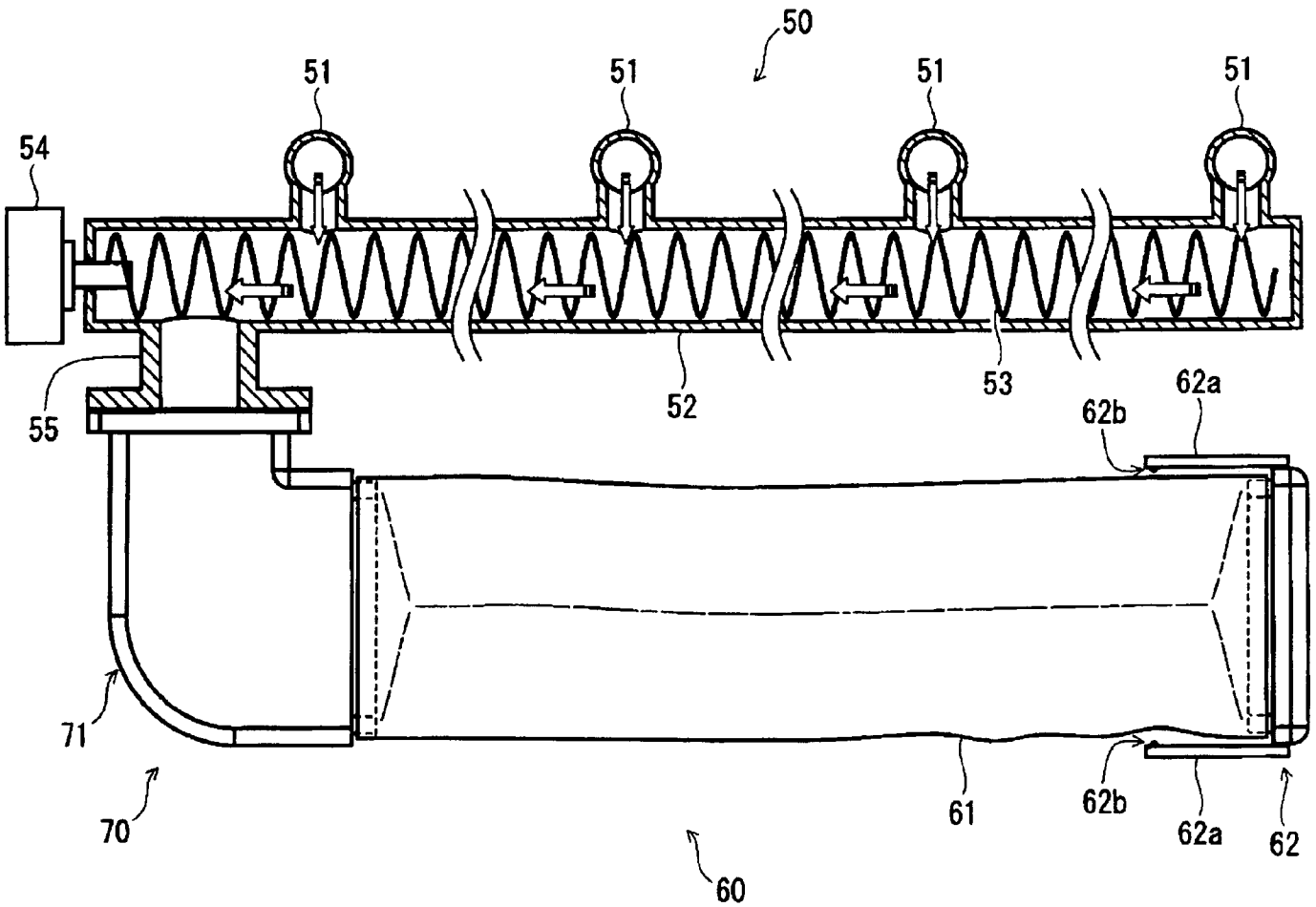
FIG. 3 is a partial vertical sectional elevation of the surrounding of a waste toner collecting device.
Figure 4:
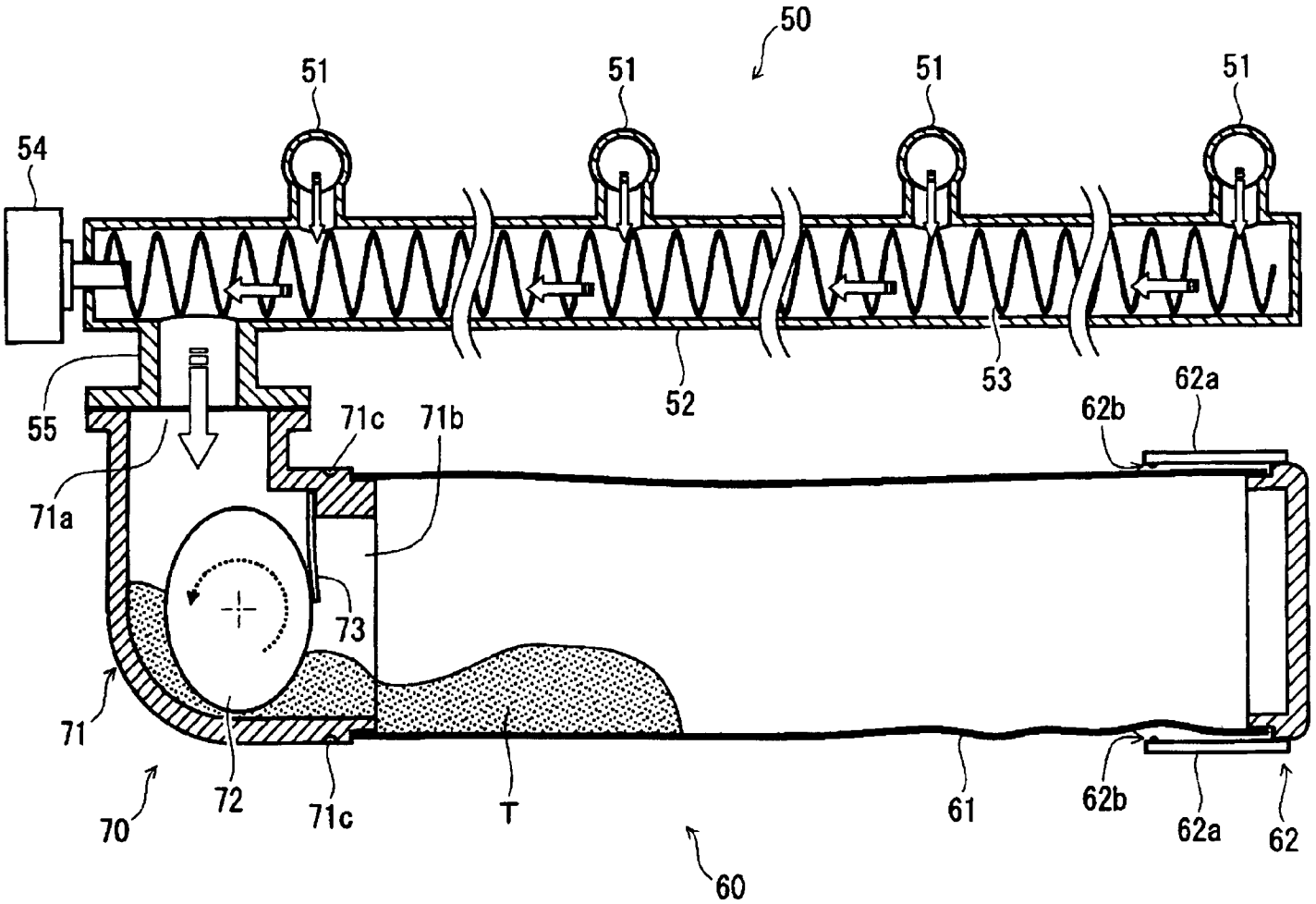
FIG. 4 is a vertical sectional elevation of the surrounding of the waste toner collecting device.

Next, the structure of the waste toner collecting device for collectively collecting waste toners stored in the cleaners 22 of the respective image formation parts 20 will be described in detail, referring to FIG. 2 and also FIGS. 3 and 4. FIG. 3 is a partial vertical sectional elevation of the surrounding of the waste toner collecting device, and FIG. 4 is a vertical sectional elevation of the surrounding of the waste toner collecting device. Note that a hollow arrow in the figures below including FIGS. 3 and 4 indicates the toner conveyance direction.

As described above, the waste toners temporarily stored in the respective cleaners 22 shown in FIG. 2 are discharged to the outside of the cleaners 22 by the toner discharge screws 23. These waste toners are gathered by a waste toner gathering mechanism 50 as shown in FIG. 3. The waste toner gathering mechanism 50 is provided between the cleaners 22 and the waste toner collecting device 60. The waste toner gathering mechanism 50 and the waste toner collecting device 60 are arranged on the front side of the main body 2 of the image forming apparatus 1.

The waste toner gathering mechanism 50 includes four gathering pipes 51, a communicating pipe 52, a conveyance spiral 53, a motor 54, and a discharge pipe 55.

The four gathering pipes 51 are respectively connected to the four cleaners 22, and waste toners are gathered through the inside of these pipes. Inside the gathering pipes 51, the toner discharge screws 23 are arranged. Then the four gathering pipes 51 are coupled to the single communicating pipe 52 at the downstream end in the toner conveyance direction. As a result, all the waste toners discharged from the respective cleaners 22 are gathered in the communicating pipe 52.

The communicating pipe 52 extends horizontally with the image forming apparatus 1, and inside the communicating pipe 52, the conveyance spiral 53 coupled to the motor 54 is arranged along the direction in which the communicating pipe 52 extends. Driving the motor 54 to rotate the conveyance spiral 53 permits the waste toner inside the communicating pipe 52 to be conveyed to one end of the communicating pipe 52, that is, to the left in FIG. 3. Near the left end of the communicating pipe 52, the discharge pipe 55 is coupled. The discharge pipe 55 extends downward from the bottom side of the communicating pipe 52, and the waste toner conveyed through the inside of the communicating pipe 52 freely falls downward and then is discharged from the discharge pipe 55.

The waste toner collecting device 60 is, as shown in FIG. 3, connected to the discharge pipe 55 of the waste toner gathering mechanism 50 configured as described above and introduces the waste toner from this discharge pipe 55. This waste toner collecting device 60 includes: a toner conveyance part 70, a waste toner collecting bag 61, and a holding member 62.

The toner conveyance part 70 of the waste toner collecting device 60 includes, as shown in FIG. 4, a tubular member 71, a roller 72, and a scraper 73.

The tubular member 71 is a square-type cylinder L-shaped in vertical cross section as viewed from the front. An inner bottom wall at an L-shaped, bent portion of the tubular member 71 is gently curved in such a manner as to extend along the circumferential surface of the roller 72 to be described later. The tubular member 71 of such a shape has: at the top thereof, a toner introduction port 71*a* provided in such a manner as to be oriented upward; and at the bottom thereof, a toner discharge port 71*b* provided in such a manner as to be oriented horizontally, that is, rightward in FIG. 4. Waste toners T collected by the cleaners 22 of the image forming apparatus 1 are fed to the toner introduction port 71*a* of the tubular member 71 and discharged from the toner discharge port 71*b*. At the outer top and bottom near the toner discharge port 71*b*, depressed parts 71*c* for fitting the holding member 62 are respectively provided.

The roller 72 is located inside the tubular member 71 and provided upstream of the toner discharge port 71*b* in the toner conveyance direction. The roller 72 has an axis of rotation substantially horizontal at a right angle to the toner conveyance direction, that is, extends in the paper depth direction of FIG. 4, and is oval-shaped in vertical cross section as viewed from the direction of axis. This roller 72 oval-shaped in vertical cross section is formed in such a size as to be rotatable about this axis inside the tubular member 71. Then the roller 72 is rotated by a motor, not shown, counterclockwise in FIG. 4.

The scraper 73 is provided on the inner wall of the tubular member 71 located downstream of the toner discharge port 71*b* side of the roller 72 in the rotation direction thereof, that is, the inner wall of the tubular member 71 located above the roller 72 in FIG. 4. The scraper 73 is a film-like member, has the substantially same axial length as that of the roller 72, and extends downward toward the roller 72 located therebelow. The scraper 73 has its leading end part located downstream of the roller 72 in the toner conveyance direction, and abuts the roller 72 while making pressure-contract therewith in a slightly bent manner.

The waste toner collecting bag 61 is fitted to the toner discharge port 71*b* of the tubular member 71 of the toner conveyance part 70. The waste toner collecting bag 61 is formed of a stretchable bag of synthetic resin or aluminum-evaporated. Then the waste toner collecting bag 61 is placed on a frame or the like, not shown, and so arranged as to extend horizontally.

The holding member 62 is attached to a terminal end part of the waste toner collecting bag 61. The holding member 62 is so shaped as to cover the terminal end part of the waste toner collecting bag 61, and its vertical cross section as viewed from the direction in which the waste toner collecting bag 61 extends is in a form and a size substantially equal to those of the vertical cross section at the toner discharge port 71*b* of the tubular member 71. Moving the holding member 62 away from the tubular member 71 in such a manner as to extend the waste toner collecting bag 61 can form the entire waste toner collecting bag 61 into a rectangular parallelepiped. At the top and bottom of the holding member 62, locking pieces 62*a* are provided which extend toward the tubular member 71. From the inner surfaces at the leading ends of these locking pieces 62*a*, projections 62*b* project which engage with the depressed parts 71*c* of the tubular member 71.

Figure 5:
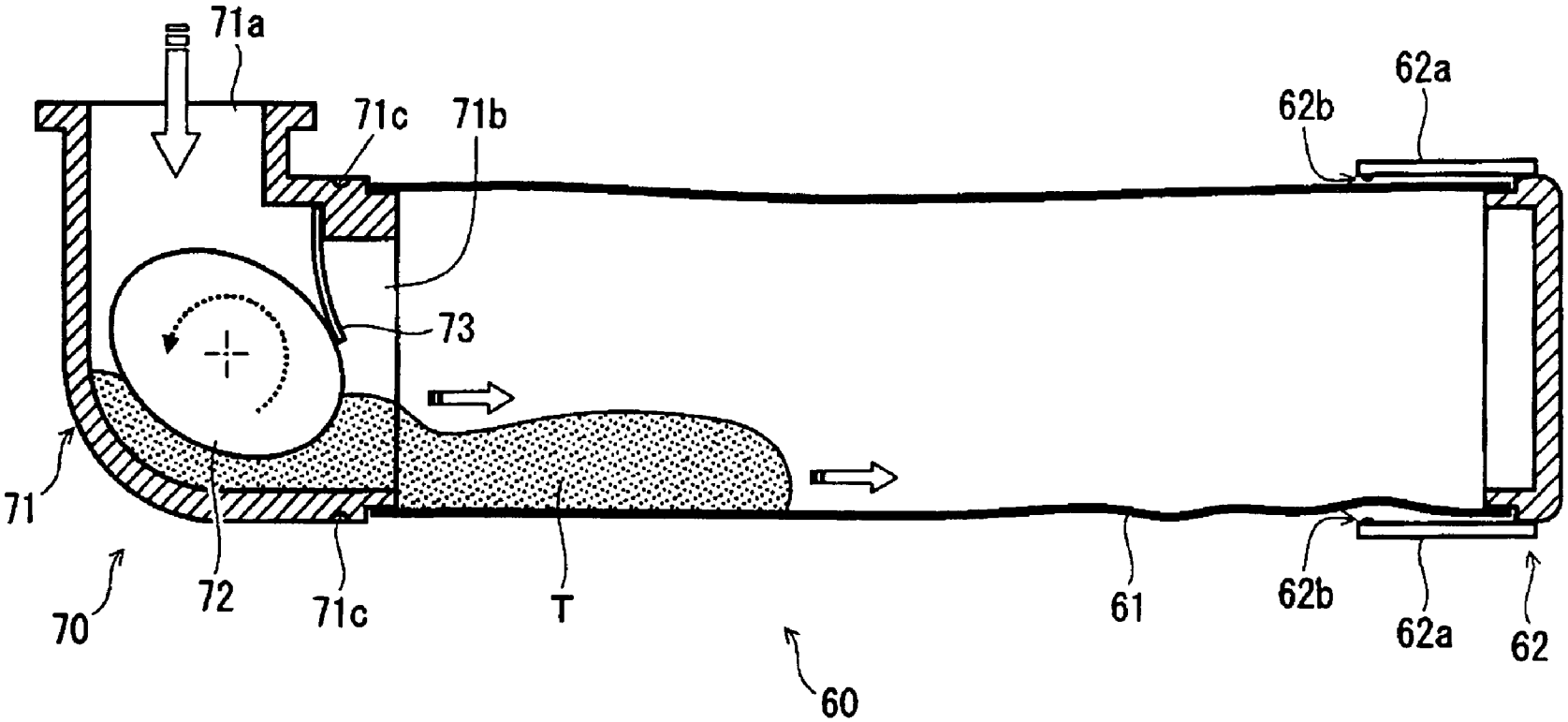
FIG. 5 is a vertical sectional elevation of the same waste toner collecting device of FIG. 4, illustrating a state in which a roller is further rotated from a state of FIG. 4.
Figure 6:
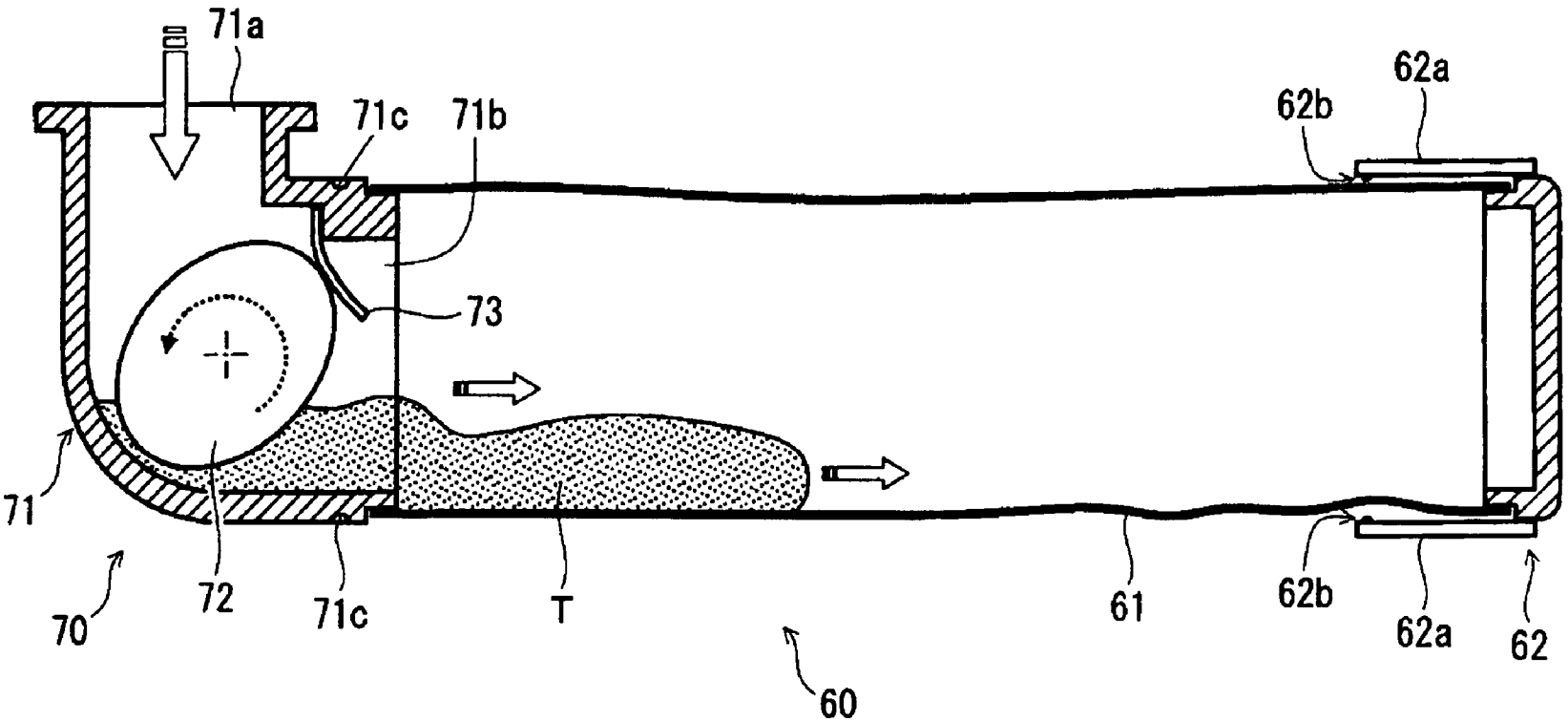
FIG. 6 is a vertical sectional elevation of the same waste toner collecting device of FIG. 5, illustrating a state in which the roller is further rotated from a state of FIG. 5.

Next, operation of collecting the waste toner T by the waste toner collecting device 60 will be described, referring to FIG. 4 and also FIGS. 5 and 6. FIG. 5 is a vertical sectional elevation of the same waste toner collecting device of FIG. 4, illustrating a state in which the roller is further rotated from the state of FIG. 4. FIG. 6 is a vertical sectional elevation of the same waste toner collecting device of FIG. 5, illustrating a state in which the roller is further rotated from the state of FIG. 5.

The waste toner T is introduced to the toner introduction port 71*a* of the tubular member 71 from the above as shown in FIG. 4. Then this waste toner T introduced to the tubular member 71 falls while traveling along the circumferential surface of the roller 72, and its large portion accumulates between the roller 72 and the inner wall of the tubular member 71, a short-axis portion of the roller 72 in particular.

Here, the roller 72 oval-shaped in vertical cross section is formed into such a size as to be rotatable about its axis inside the tubular member 71. Consequently, when the roller 72 rotates, at the bottom of the tubular member 71 as shown in FIGS. 4 to 6, the roller 72 rotationally moves while a section of the circumferential surface at the long axis of the roller 72 approaches closest to the gently bent, curved surface section of the inner wall of the tubular member 71.

When the roller 72 is rotated from the state of FIG. 4 to the state of FIG. 5 and further to the state of FIG. 6, the long-axis portion of the roller 72 conveys the waste toner T accumulated at the short-axis portion thereof and located on the toner discharge port 71*b* side toward the waste toner collecting bag 61 in such a manner as to scrape it.

When the rotation of the roller 72 continues, operation of conveying the waste toner T accumulated at the short-axis portion of the roller 72 by the long-axis portion thereof toward the waste toner collecting bag 61 in such a manner as to scrape it is repeatedly executed.

On the other hand, above the roller 72, as described above, the scraper 73 is provided. Since the scraper 73 abuts the roller 72 at its leading end part while making pressure-contract therewith, the scraper 73 can scrape off the waste toner T adhering to the surface of the roller 72. Further, the scraper 73, when the waste toner T is filled up to the top of the roller 72, swings its leading end following the rotation of the roller 72, thereby pushing the waste toner T into the waste toner collecting bag 61.

In this manner, the toner conveyance part 70 conveys the waste toner T introduced to the toner introduction port 71*a* of the tubular member 71 by using the roller 72, and also discharges it horizontally from the toner discharge port 71*b* toward the waste toner collecting bag 61.

Figure 7:
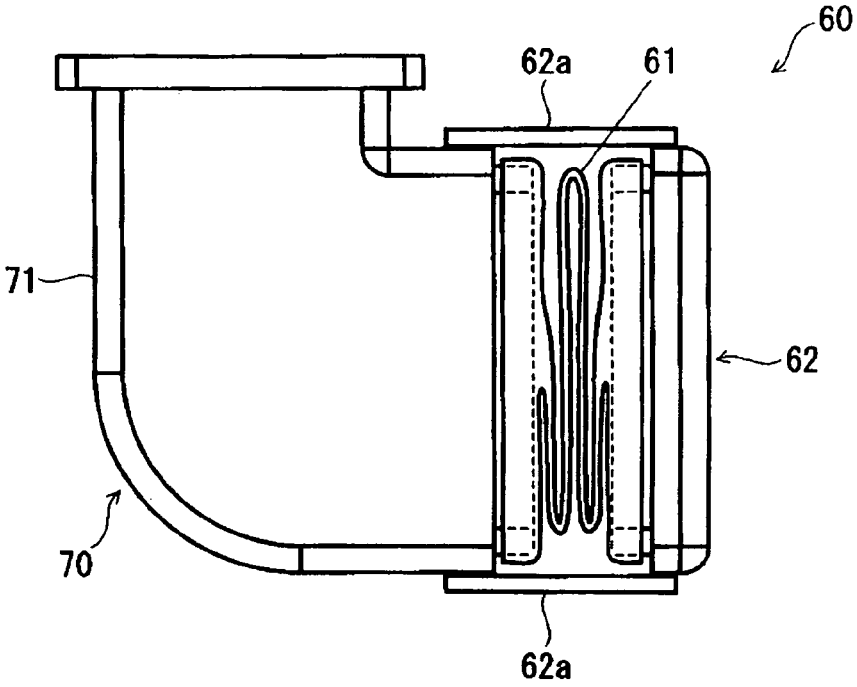
FIG. 7 is an elevation of the waste toner collecting device, illustrating a state in which a waste toner collecting bag is held in a folded manner.
Figure 8:
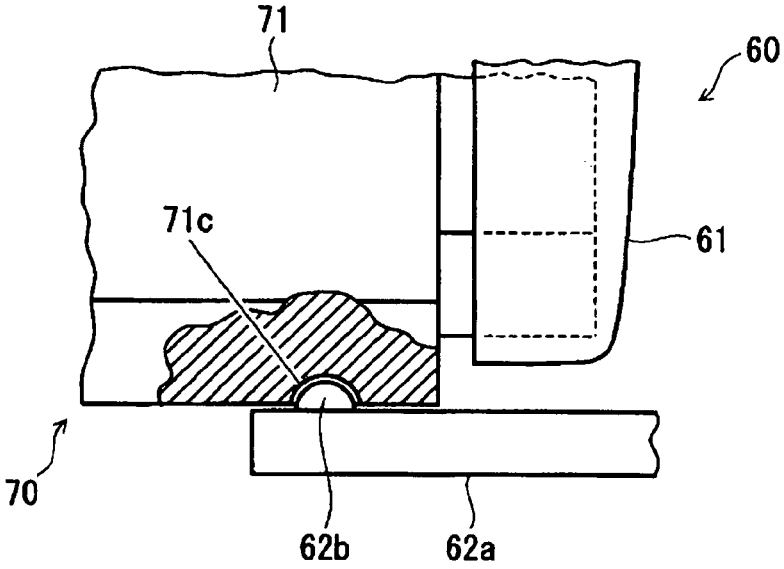
FIG. 8 is a partially enlarged elevation illustrating an engagement section between a toner conveyance part and a holding member of the waste toner collecting device of FIG. 7.

Subsequently, the configuration for a storage state of the waste toner collecting device 60 will be described, referring to FIGS. 3 to 6 and also FIGS. 7 and 8. FIG. 7 is an elevation of the waste toner collecting device, illustrating a state in which the waste toner collecting bag is held in a folded manner, and FIG. 8 is a partially enlarged elevation illustrating an engagement section between the toner conveyance part and the holding member of the waste toner collecting device shown in FIG. 7.

The waste toner collecting device 60 shown in FIGS. 3 to 6 is depicted in a used state during waste toner collection. Then FIG. 7 depicts a stored state of the waste toner collecting device 60 before use for the waste toner collection. The waste toner collecting device 60 is, in the stored state, made compact while the waste toner collecting bag 61 is folded more compactly than in the used state.

To make the waste toner collecting device 60 compact in this manner, the waste toner collecting bag 61 is held between the toner conveyance part 70 and the holding member 62 in such a manner as to be folded in a wave form from the toner conveyance part 70 to the holding member 62. Thereafter, the holding member 62 provided at the terminal end of the waste toner collecting bag 61 is fitted to the toner conveyance part 70.

As described above, at the top and bottom of the holding member 62, the locking pieces 62*a* are so provided as to extend toward the tubular member 71 of the toner conveyance part 70, and from the inner surfaces at the leading ends of these locking pieces 62*a*, the projections 62*b* project which engage with the depressed parts 71*c* of the tubular member 71. Engaging the locking pieces 62*a* with the depressed parts 71*c* as shown in FIG. 8 permits fitting the holding member 62 to the toner conveyance part 70.

The locking piece 62*a* of the holding member 62 can be elastically and manually deformed with ease to such an extent that freely engages the projection 62*b* with the depressed part 71*c* or releases this engagement. That is, the holding member 62 is removable from and attachable to the toner conveyance part 70 by using a snap-fit method.

In this manner, the holding member 62 can be fitted to the toner conveyance part 70 by holding the waste toner collecting bag 61 between the holding member 62 and the toner conveyance part 70 while folding the waste toner collecting bag 61 more compactly than in a used state.

As described above, since the waste toner collecting device 60 provided with the stretchable waste toner collecting bag 61 includes: the toner conveyance part 70 which is fitted with the waste toner collecting bag 61, which conveys a waste toner, and which discharges the waste toner toward the waste toner collecting bag 61; and the holding member 62 for the waste toner collecting bag 61, which holding member 62 is attached to the terminal end part of the waste toner collecting bag 61, which can be fitted to the toner conveyance part 70 by holding the waste toner collecting bag 61 between the holding member 62 and the toner conveyance part 70 while folding the waste toner collecting bag 61 more compactly than in a used state, and which is attachable to and removable from the toner conveyance part 70, it is possible to protect the waste toner collecting bag 61 while achieving its compactification when the waste toner collecting device 60 is in a stored state. Then removing the holding member 62 from the toner conveyance part 70 and moving it away from the toner conveyance part 70 while extending the folded waste toner collecting bag 61 permits easily spreading the waste toner collecting bag 61 into a preferable form. In this manner, a waste toner collecting device 60 can be provided which is capable of easily protecting the waste toner collecting bag 61 against accidental breakage, which is capable of spreading the waste toner collecting bag 61 without bending or twisting it when using it, and also which is capable of reliably storing a larger amount of waste toner.

Moreover, since the holding member 62 is attachable to and removable from the toner conveyance part 70 by using the snap-fit method, it is possible to hold the waste toner collecting bag 61 while keeping it folded without using a locking member such as a screw and also easily spread it. This permits achieving lower cost and power saving for operations involved in protecting and spreading the waste toner collecting bag 61.

Then since the waste toner collecting bag 61 is held between the toner conveyance part 70 and the holding member 62 in such a manner as to be folded in a wave form from the toner conveyance part 70 to the holding member 62, no special processing is required for the form, folded state, and spread state of the waste toner collecting bag 61. Then it is possible to spread the waste toner collecting bag 61 in a flexible form. Therefore, an even larger waste toner collecting bag 61 can be folded compactly and can be spread while extended in various forms. As a result, it is possible to improve the effect that, while protecting the waste toner collecting bag 61 in a stored state against accidental breakage, the waste toner collecting bag 61 is extended in a form that facilitates the waste toner storage and then an even larger amount of toner is stored.

Moreover, since the toner conveyance part 70 includes: the tubular member 71 provided with the toner introduction port 71*a* and the toner discharge port 71*b*; the roller 72 which is provided inside the tubular member 71 and upstream of the toner discharge port 71*b* in the toner conveyance direction, which has a substantially horizontal axis of rotation, and which is oval-shaped in vertical cross section; and the scraper 73 which is provided on the inner wall of the tubular member 71 downstream of the toner discharge port 71*b* side of the roller 72 in the rotation direction thereof and which abuts the roller 72 at its leading end part, it is possible to deliver the waste toner collected from the toner introduction port 71*a* further inside by the roller 72 oval-shaped in vertical cross section and prevent its reversed flow by the action of the scraper 73. As a result, the waste toner can be pushed further inside of the bag even if the waste toner collecting bag 61 has not been expanded much after the initial state and also even when the bag is deformed along with the waste toner collection. This therefore can prevent a problem that the waste toner accumulates at the toner conveyance part 70. Then since the waste toner is delivered further inside of the waste toner collecting bag 61 by using the roller 72, the waste toner collecting bag 61 is not necessarily so structured as to extend vertically. As a result, a waste toner collecting device 60 can be provided which is capable of protecting the waste toner collecting bag 61 in a stored state against accidental breakage and also which prevents a waste toner from accumulating at the toner conveyance part 70 to thereby reliably store a larger amount of waste toner without providing design restrictions on the configuration of the waste toner collecting device 60.

Further, since the waste toner collecting bag 61 is so arranged as to extend horizontally, it is very effective in configuration that can ensure sufficient space for arranging the waste toner collecting bag 61 in a horizontal direction although it cannot ensure a space in a vertical direction. In this manner, a waste toner collecting device 60 can be provided which can easily protect the waste toner collecting bag 61 in a stored state against accidental breakage, which can be spread in a preferable form when used, which can reliably store a larger amount of waste toner, and which extends horizontally long. This therefore can greatly widen the applicability of the waste toner collecting device 60 capable of reliably storing a larger amount of waste toner.

Moreover, since the waste toner collecting device 60 described above is loaded in the image forming apparatus 1 in the invention, a high-performance image forming apparatus 1 can be provided which can easily protect the waste toner collecting bag 61 in a stored state against accidental breakage, which can spread the waste toner collecting bag 61 without bending or twisting it when using it, and which can reliably store a larger amount of waste toner.

Further, since the image forming apparatus 1 uses toners of a plurality of colors, and also includes the single waste toner collecting device 60 that collects the toners of all these colors, even an image forming apparatus 1 capable of color image formation using a plurality of colors does not require provision of waste toner collecting devices 60 corresponding to the respective colors, which permits a reduction in the number of waste toner collecting bags 61 to be stored. Therefore a risk that the waste toner collecting bag 61 in a stored state suffers from accidental breakage can be reduced. Moreover, a reduction in the number of components and space saving can be achieved. This permits improving the effect that upon the use of the waste toner collecting bag 61, it can be spread without being bent or twisted and that a larger amount of waste toner T can be reliably stored, and also the effect that the waste toner collecting bag 61 in a stored state is protected, thus making it possible to achieve lower costs and downsizing of the image forming apparatus 1.

Figure 9:
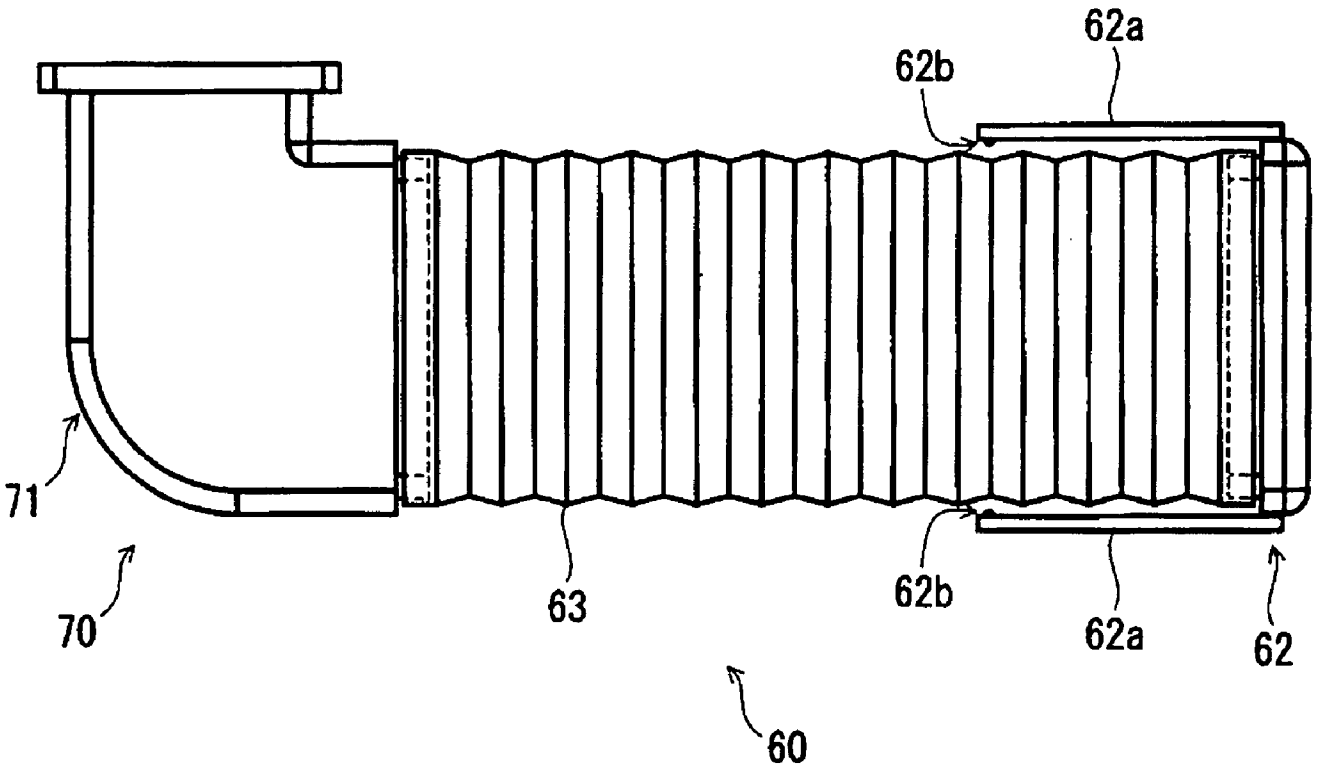
FIG. 9 is an elevation of a waste toner collecting device according to a second embodiment of the invention.
Figure 10:
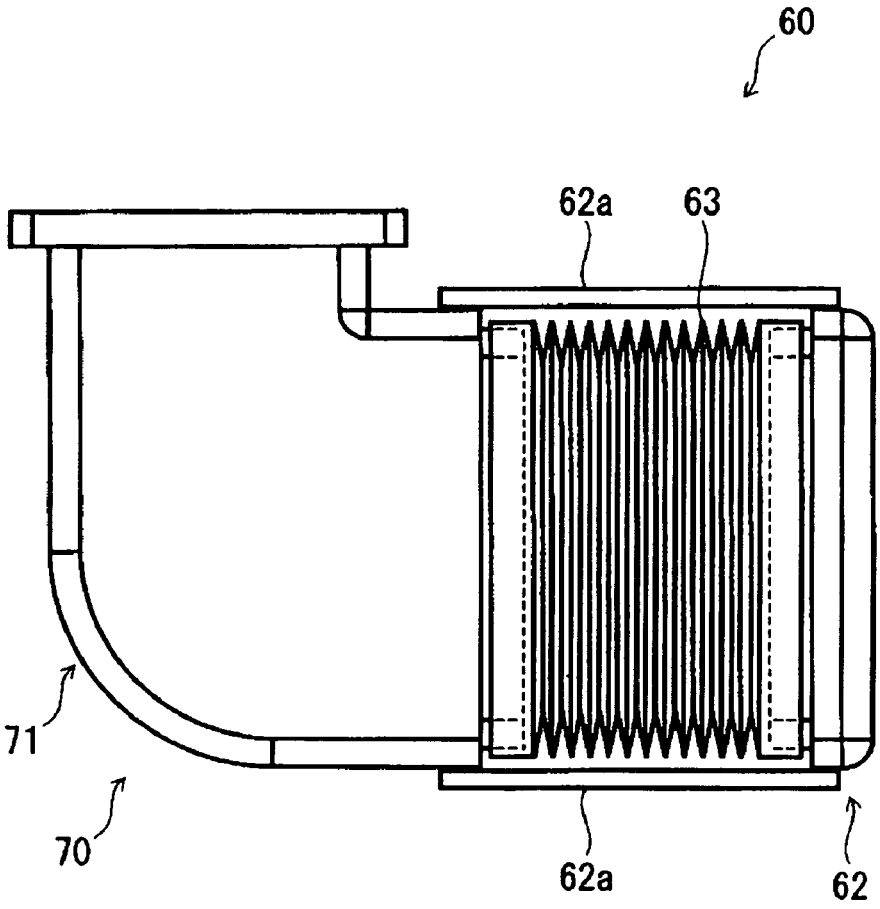
FIG. 10 is an elevation of the same waste toner collecting device of FIG. 9, illustrating a state in which a waste toner collecting bag is held in a folded manner.

Next, the structure of a waste toner collecting device according to the second embodiment of the invention will be described, referring to FIGS. 9 and 10. FIG. 9 is an elevation of the waste toner collecting device, and FIG. 10 is an elevation of the same waste toner collecting device of FIG. 9, illustrating a state in which a waste toner collecting bag is held in a folded manner. The basic structure of this embodiment is the same as that of the first embodiment described referring to FIGS. 1 to 8, and components in common with those of the first embodiment are provided with the same numerals and omitted from the description.

The waste toner collecting device 60 according to the second embodiment includes, as shown in FIGS. 9 and 10, a waste toner collecting bag 63 shaped into a bellows form. As a result, when the waste toner collecting device 60 is in a stored state, as shown in FIG. 10, the waste toner collecting bag 63 is held between a toner conveyance part 70 and a holding member 62 in such a manner as to be folded in a bellows form from the toner conveyance part 70 to the holding member 62.

Therefore, it is possible to reliably and easily spread the waste toner collecting bag 63 without bending or twisting the waste toner collecting bag 63 to such an extent that makes it difficult to store a waste toner. As a result, it is possible to improve the effect that, while protecting the waste toner collecting bag 63 in a stored state against accidental breakage, a larger amount of waste toner is stored in the waste toner collecting bag 63.

Figure 11:
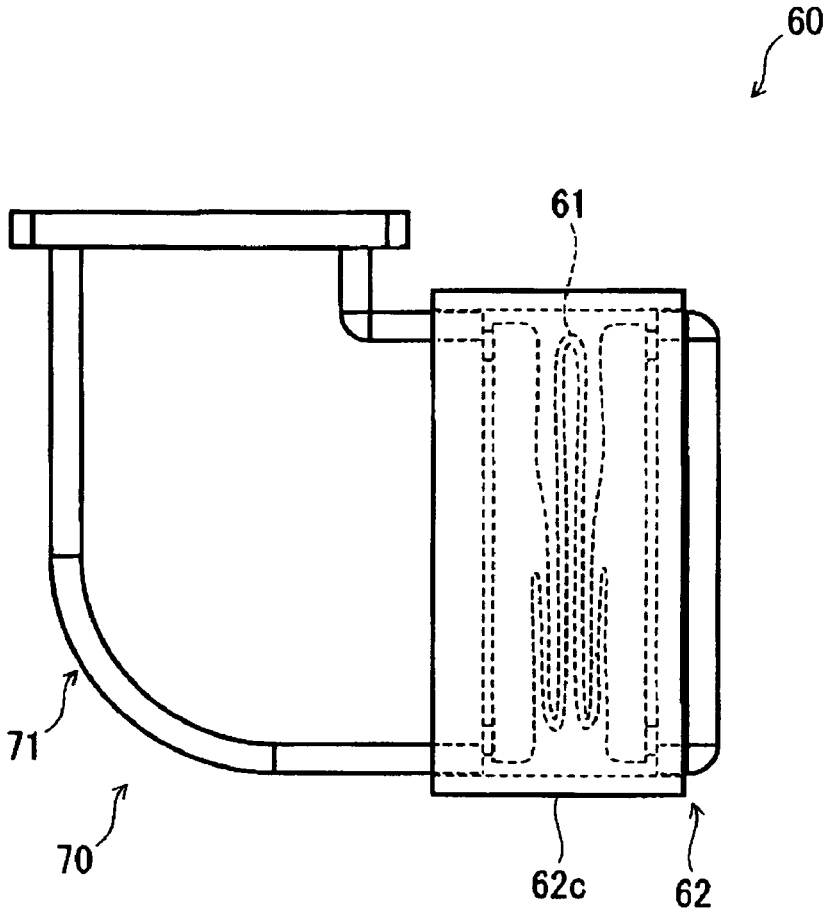
FIG. 11 is an elevation of a waste toner collecting device according to a third embodiment of the invention, illustrating a state in which a waste toner collecting bag is held in a folded manner.

Next, the structure of a waste toner collecting device according to the third embodiment of the invention will be described, referring to FIG. 11. FIG. 11 is an elevation of the waste toner collecting device, illustrating a state in which a waste toner collecting bag is held in a folded manner. The basic structure of this embodiment is the same as that of the first embodiment described referring to FIGS. 1 to 8, and components in common with those of the first embodiment are provided with the same numerals and omitted from the description.

The waste toner collecting device 60 according to the third embodiment includes, as shown in FIG. 11, a holding member 62 provided with a cover part 62*c*. This cover part 62*c* of the holding member 62 is shaped into a square cylindrical form, and extends from the terminal end side of a waste toner collecting bag 61 toward a toner conveyance part 70. The inside of the cover part 62*c* is shaped into a form and a size that permit admitting the waste toner collecting bag 61 folded more compactly than in a used state. Further, the inside of the cover part 62*c* at its leading end is shaped into a form and a size that permit admitting a toner discharge port 71*b* section of a tubular member 71 of the toner conveyance part 70. From the inner surfaces of the cover part 62*c* at the leading ends, as is with the first embodiment, projections 62*b* (not shown) project which engage with depressed parts 71*c* of the tubular member 71.

When the holding member 62 configured as described above is fitted to the toner conveyance part 70 while folding the waste toner collecting bag 61 more compactly than in a used state, the waste toner collecting bag 61 can be completely stored and covered inside the holding member 62 in such a manner that the cover part 62*c* covers the surrounding of the waste toner collecting bag 61. Consequently, the waste toner collecting bag 61 in a stored state can be reliably protected against accidental breakage and can also be spread without being bent or twisted when used.

The embodiments of the invention have been described above, but the scope of the invention is not limited to them, and thus the invention can be embodied through various modifications within the scope not departing from the spirits of the invention.

For example, in the embodiments of the invention, the image forming apparatus 1 is of the color-print type that transfers toner images of a plurality of colors onto paper P by using the intermediate transfer belt 8. However, the type of the image forming apparatus is not limited to this, and thus it may be of a type that does not use an intermediate transfer belt or a type for monochrome printing.

Moreover, in the embodiments described above, the waste toner collecting device 60 collects waste toners from the cleaners 22 at the four sections for the photoconductive drums 21 via the waste toner gathering mechanism 50, and it is also possible to further collect a waste toner from the cleaner 9 for the intermediate transfer belt 8.

What is claimed is:

1. A waste toner collecting device comprising:

a waste toner collecting bag being stretchable;

a toner conveyance part fitted with the waste toner collecting bag, and conveying a waste toner and also discharging the waste toner toward the waste toner collecting bag; and a holding member for the waste toner collecting bag, the holding member being attached to a terminal end part of the waste toner collecting bag, being capable of being fitted to the toner conveyance part by holding the waste toner collecting bag between the holding member and the toner conveyance part while folding the waste toner collecting bag more compactly than in a used state, and being attachable to and removable from the toner conveyance part.

2. The waste toner collecting device according to claim 1, wherein the holding member is attachable to and removable from the toner conveyance part by using a snap-fit method.

3. The waste toner collecting device according to claim 1, wherein the waste toner collecting bag is held between the toner conveyance part and the holding member in such a manner as to be folded in a wave form from the toner conveyance part to the holding member.

4. The waste toner collecting device according to claim 1, wherein the waste toner collecting bag is held between the toner conveyance part and the holding member in such a manner as to be folded in a bellows form from the toner conveyance part to the holding member.

5. The waste toner collecting device according to claim 1, wherein the toner conveyance part comprises:

a tubular member provided with a toner introduction port and a toner discharge port;

a roller provided inside the tubular member and upstream of the toner discharge port in a toner conveyance direction, having a substantially horizontal axis of rotation, and being oval-shaped in vertical cross section; and a scraper provided on an inner wall of the tubular member downstream of the toner discharge port side of the roller in a rotation direction thereof and having a leading end thereof abutting the roller.

6. The waste toner collecting device according to claim 1, wherein the waste toner collecting bag is arranged in such a manner as to extend horizontally.

7. The waste toner collecting device according to claim 1, wherein the holding member comprises a cover part covering surrounding of the waste toner collecting bag when fitted to the toner conveyance part.

8. An image forming apparatus loaded with a waste toner collecting device, wherein the waste toner collecting device comprises:

a waste toner collecting bag being stretchable;

a toner conveyance part fitted with the waste toner collecting bag, and conveying a waste toner and also discharging the waste toner toward the waste toner collecting bag; and a holding member for the waste toner collecting bag, the holding member being attached to a terminal end part of the waste toner collecting bag, being capable of being fitted to the toner conveyance part by holding the waste toner collecting bag between the holding member and the toner conveyance part while folding the waste toner collecting bag more compactly than in a used state, and being attachable to and removable from the toner conveyance part.

9. The image forming apparatus according to claim 8, using toners of a plurality of colors and comprising the single waste toner collecting device collecting the toners of all the colors.

* * * * *